United States Patent [19]

Kidd

[11] Patent Number: 4,643,314

[45] Date of Patent: Feb. 17, 1987

[54] CONTAINER CONSTRUCTION

[75] Inventor: Garry B. Kidd, Novi, Mich.

[73] Assignee: Chrysler Motors Corporation, Highland Park, Mich.

[21] Appl. No.: 866,801

[22] Filed: May 27, 1986

[51] Int. Cl.[4] ..... B65D 19/00; B65D 21/02; B65D 6/18; B65D 25/04

[52] U.S. Cl. ..... 206/600; 206/509; 206/386; 217/16; 217/43 A; 220/6; 220/22

[58] Field of Search ..... 206/508, 509, 599, 600, 206/386; 220/6, 7, 22, 22.3; 217/7, 16, 43 R, 43 A

[56] References Cited

U.S. PATENT DOCUMENTS

| | | | |
|---|---|---|---|
| 590,510 | 9/1897 | Bonta | 217/16 |
| 1,231,977 | 7/1917 | Winship | 217/16 |
| 2,534,010 | 12/1950 | Frye | 206/600 |
| 3,984,023 | 10/1976 | Hodas | 220/22 |
| 4,254,873 | 3/1981 | Cook | 206/600 |

FOREIGN PATENT DOCUMENTS

| | | | |
|---|---|---|---|
| 2086351 | 5/1982 | United Kingdom | 206/600 |

OTHER PUBLICATIONS

Plastic Corrugated Container CS903, CS904.

*Primary Examiner*—George E. Lowrance
*Attorney, Agent, or Firm*—Edward A. Craig

[57] ABSTRACT

A container construction is provided having an erected configuration and a storage configuration. The container construction comprises a pallet, a sidewall structure, a divider and a lid. These elements may be erected into a container construction or disassembled from an erected container construction and formed into storage packs.

13 Claims, 13 Drawing Figures

CONTAINER CONSTRUCTION

This application is related to my co-pending application Ser. No. 866,820, filed May 27, 1986.

BACKGROUND OF THE INVENTION

1. Field of the Invention

This invention relates to a container construction having an erected configuration and a storage configuration. The container construction includes a pallet, a sidewall structure, a divider and a lid, each of which is a separate item.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly location in containers. Two problems have arisen in connection with use of prior art containers. One type of container which has been in common use in the past is the throwaway container. Such containers are fabricated of such materials as cardboard and low grade wood. Throwaway containers have presented a serious disposal problem at assembly plants. It is quite costly to handle, store and transport empty throwaway containers.

However, throwaway containers have had the advantage of being low cost items as compared with conventional reusable containers that have been used in the past. Reusable containers have had the disadvantage of being initially quite expensive and being expensive to transport back from an assembly location to the location of the origin of parts and components for refilling and reshipment. Collapsible containers have been suggested. However, such collapsible containers have suffered from a low return ratio. The return ratio is the ratio between a fully erected container and a collapsed and stored container. For example, it has been common in the past for one erected container to equal three collapsed containers. This ratio is relatively low and entails an expensive shipping cost. Another disadvantage of such containers of the past is that they have been formed of relatively thick wall structure material which not only reduces the return ratio but also reduces the amount of space inside of an erected container for storage of material, thereby resulting in relatively high original shipping costs.

Collapsible sidewall structure of relatively high strength and thin configuration has recently been available for use in constructing containers. Such a collapsible sidewall structure is offered by, for example, Peninsula Plastic Co., Inc. of Auburn Hills, Mich. The material for the sidewalls is a cellular plastic material made in sheet form. The plastic material is an impact resistant polycarbonate. General Electric Company of Stamford, Conn. markets the sheet material under the trademark LEXAN.

In accordance with the present invention, the container construction has an erected configuration and a storage configuration wherein when erected, an attempt is made to maximize the interior storage space and to configure the exterior dimensions to fit cargo trailers with efficiency, particularly cargo trailers referred to as "sea trainers" which are cargo trailers shipped by ocean vessels. When dismantled and stored for return shipment, the container's construction is formable into storage packs which have a return ratio of 1:5, that is one storage pack assumes the same external volume as one-fifth of an erected container.

The broad concept of a container comprising a pallet, a sidewall structure, and a lid, each being a separate item which is separately storable and erectable into a container, has been suggested in the past. However, the present invention provides a configuration for these elements which provides desirable space saving aspects in a rugged, easily assemblable and dissassemblable storage unit construction.

SUMMARY OF THE INVENTION

The container construction comprises a pallet, a sidewall structure, a divider and a lid. The pallet is generally rectangular and includes a bottom wall having an upper face and a lower face. Sidewall means extend around the periphery of the bottom wall on the upper face thereof. The bottom wall has a pair of substantially parallel spaced apart hollow raised portions on the upper face extending between two opposed edges of the bottom wall defining a pair of channels to receive the skids of a fork lift truck. Lug structure is provided on the upper face of the bottom wall. The lug structure extends around the inner periphery of the sidewall means and is spaced therefrom to form, with the pallet sidewall means, a support structure receiving the lower edges of the sidewall structure. A shelf structure extends from the lug structure to the sidewall means for support of the lower edges of the sidewall structure. A shelf structure extends from the lug structure to the pallet sidewall means to support the lower edges of the sidewall structure. The shelf structure is spaced from the bottom wall and in horizontal alignment with the raised portions. Channel structure is provided on the upper surface of the bottom wall extending between and substantially parallel to the hollow raised portions for receiving the lower edge of the divider. A pair of spaced apart projections are provided on the pallet sidewall means at each end of the channel structure on the upper surface of the bottom wall with the spaces therebetween being in alignment with the channel structure and receiving corner portions of the lower edge of the divider.

The sidewall structure comprises four vertical wall members. First hinge means connect the four wall members together along vertical edges thereof to form a generally rectangular box-like structure with the lower edges thereof being received in the space between the lug structure and pallet sidewall means as aforesaid. Each of two oppositely disposed wall members of the sidewall structure comprises a pair of panels of substantially equal size. The first hinge means connect one vertical edge of the panels to a vertical edge of an adjacent sidewall member to result in the aforesaid connection. Second hinge means connect the remaining adjacent vertical edges of each pair of adjacent panels together. A vertical channel is defined by the second hinge means and adjacent edges of each pair of adjacent panels. Each of these vertical channels is in alignment with the channel structure on the upper surface of the pallet bottom wall.

The divider comprises a wall member extending between the sidewall members which comprise a pair of panels. The divider has vertical edge portions received in the vertical channels and a lower edge portion received in the channel structure on the upper surface of the pallet bottom wall with lower corner portions of the divider being received between the pairs of spaced apart projections. The vertical edge portions of the divider each have an elongated projection extending outwardly from the upper portions thereof. The projections terminate intermediate the upper end lower edges of the divider.

The lid is generally rectangular and has a top wall with an upper face and a lower face. Sidewall means extend around the periphery of the top wall on the lower face thereof. Lug structure is provided on the lower face of the top wall extending around the inner periphery of the lid sidewall means and spaced therefrom to form, with the lid sidewall means, a support structure received on the upper edges of the sidewall structure. Channel structure is provided on the lower surface of the top wall extending between the vertical channel defined by the second hinge means and panels. The divider has an upper edge portion received in the channel structure on the lower surface of the top wall.

The lower face of the pallet bottom wall and the upper face of the lid top wall each have an irregular surface configuration. The irregularities of the two surfaces mate when one container is stacked upon another to thereby block the two surfaces against sliding with respect to each other.

BRIEF DESCRIPTION OF THE PREFERRED EMBODIMENT

Figure 1:
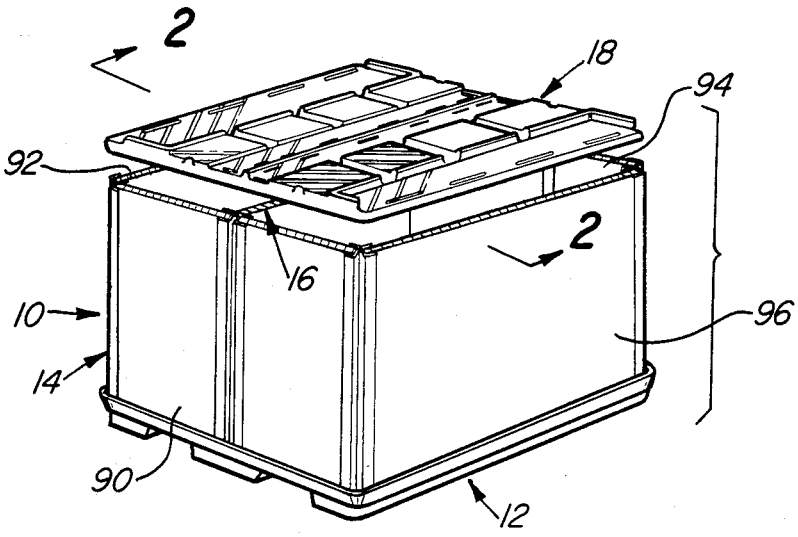
FIG. 1 is a view in perspective of an erected container construction with the lid removed for the purpose of clarity.
Figure 2:
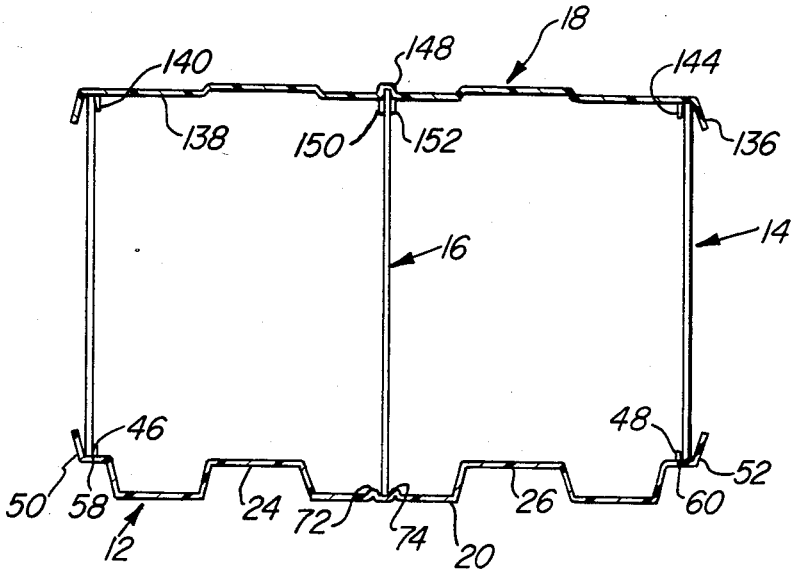
FIG. 2 is a sectional view of the container construction of FIG. 1 with the lid in place and taken substantially along the line 2—2 looking in the direction of the arrows.

Referring to FIGS. 1 and 2, it will be noted that the container construction 10, illustrated in the erected configuration, comprises a pallet 12, a sidewall structure 14, a divider 16 and a lid 18.

Figure 4:
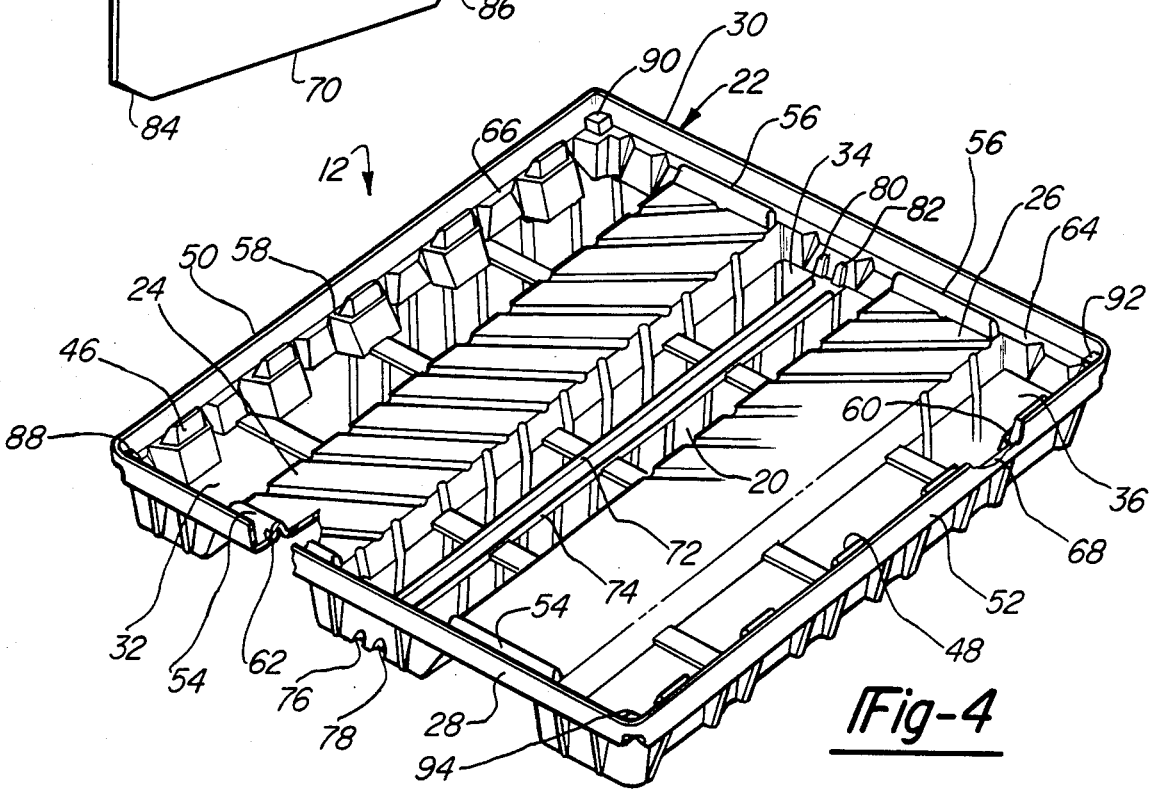
FIG. 4, is a view in perspective of the container pallet.
Figure 5:
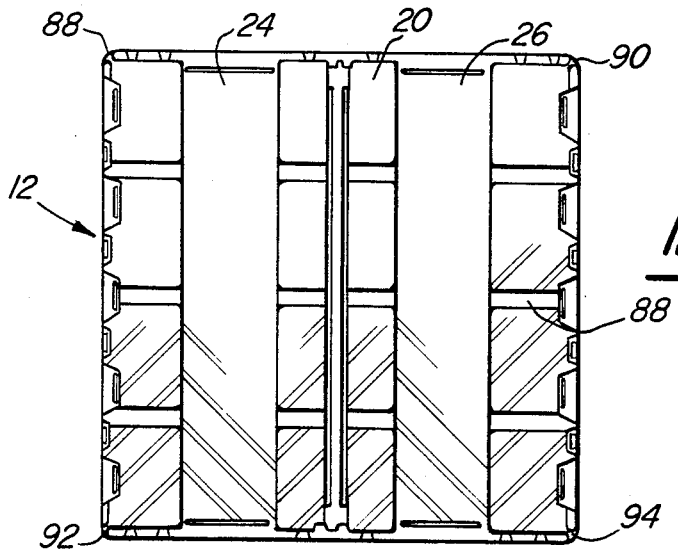
FIG. 5 is a plan view of the underside of the container pallet.

As further illustrated in FIGS. 4 and 5, the pallet 12 is generally rectangular and includes a bottom wall 20 having an upper face and a lower face. Sidewall means 22 extend around the periphery of the bottom wall 20 on the upper face thereof. The bottom wall 20 has a pair of substantially parallel spaced apart hollow raised portions 24, 26 on the upper face extending between two opposed edges 28, 30 of the pallet 12. The raised portions 24, 26 are open ended and define a pair of channels to receive the skids of a fork lift truck. The skids may be inserted into the raised portions 24, 26 from either of the two edges 28, 30. Raised portions are not provided transversely to the raised portions 24, 26. The reason for this is that by not providing a second set of raised portions, elongated, uninterrupted storage wells, 32, 34, 36 remain between the raised portions 24 and 26. These storage wells increase the cubic loading capacity of an erected container and are particularly useful for elongated items such as vehicle wiring harnesses.

Lug structure is provided on the upper face of the bottom wall 20 extending around the inner periphery of the pallet sidewall means 22 and spaced therefrom to form, with the pallet sidewall means 22, a support structure receiving the lower edges 38, 40, 42, 44 of the sidewall structure 14. The lug structure comprises a plurality of spaced-apart lug elements 46, 48 which are provided adjacent the pallet edges 50, 52 and spaced-apart lug elements 54, 56 which are provided on the raised portions 24, 26 adjacent the pallet edges 28, 30. A shelf structure 58, 60 and 62, 64 extends from each lug element to the pallet sidewall means 22 for support of the lower edges 38, 40, 42, 44 of the sidewall structure 14. The shelf structures are spaced from the bottom wall 20 and are in horizontal alignment with the upper surfaces of the raised portions 24, 26. Additional shelf structures 66, 68 are provided adjacent the pallet edges 50, 52, one of the shelf structures 66, 68 being provided between each pair of adjacent lug elements 46, 48.

Channel structure is provided on the upper surface of the bottom wall 20 extending between and substantially parallel to the hollow raised portions 24, 26 for receiving the lower edge 70 of the divider 16. The channel structure comprises a pair of elongated generally parallel spaced-apart rib elements 72, 74. The rib elements 72, 74 terminate short of the pallet sidewall means 22 for ease of mounting the divider 16. A pair of spaced apart projections 76, 78, and 80, 82 are provided on the pallet sidewall means 22 at each end of the rib elements 72, 74 with the spaces between the projections being in alignment with the channel structure defined by the ribs 72, 74. The projections 76, 78, and 80 and 82 function to receive corner portions 84, 86 of the lower edge of the divider 16. As will be noted, the corner portions 84, 86 are angled to match the outward flare of the sidewall means 22. The sidewall means 22 is outwardly flared to permit nesting of pallets in a stack for storage purposes.

A projection 88, 90, 92, 94 is provided in each corner of the pallet on the sidewall means 22 to receive and support the lower corners of the sidewall structure 14. As will be noted, the pallet 12 is generally ribbed to provide structural reinforcement for the unit. A plurality of elongated depressions 88 are provided on the lower face of the bottom wall 20 to receive straps for bundling erected containers or stacked and stored container elements as is conventional.

Figure 7:
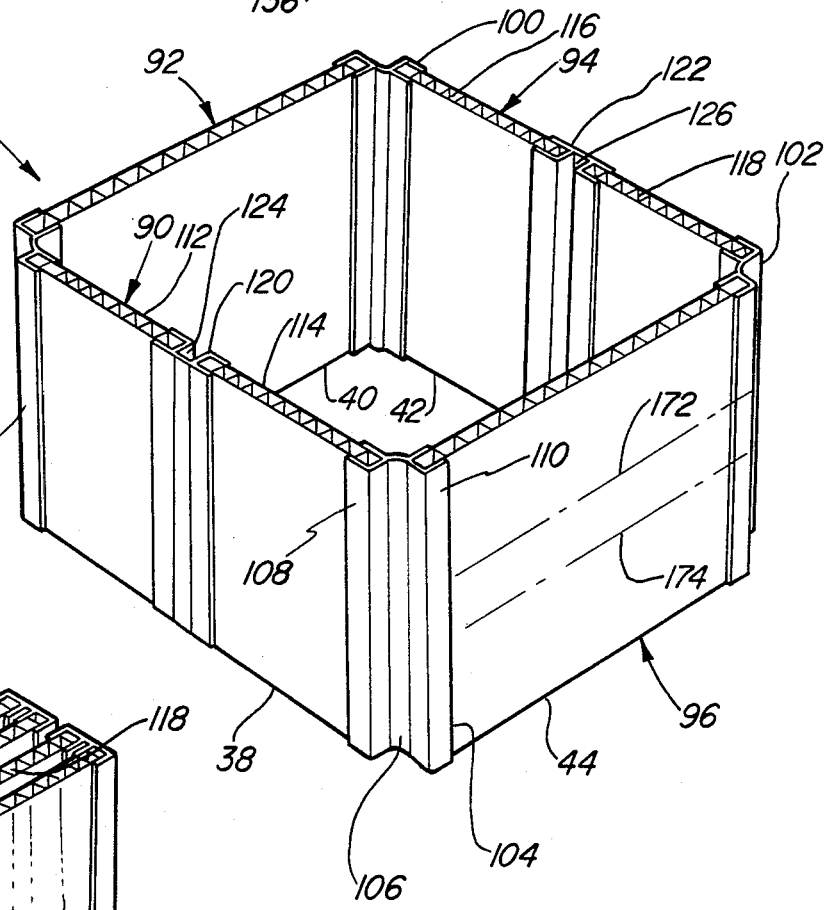
FIG. 7 is a view in perspective of the container sidewall structure in the erected configuration.
Figure 8:
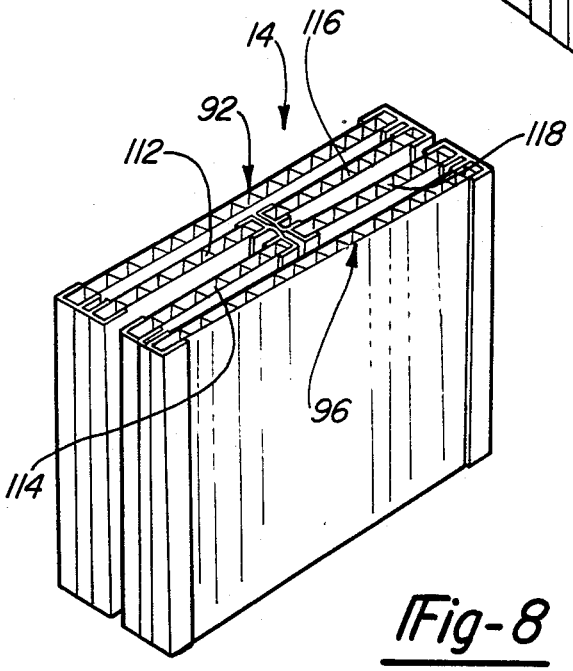
FIG. 8 is a view in perspective of the container sidewall structure in the storage configuration.
Figure 9:
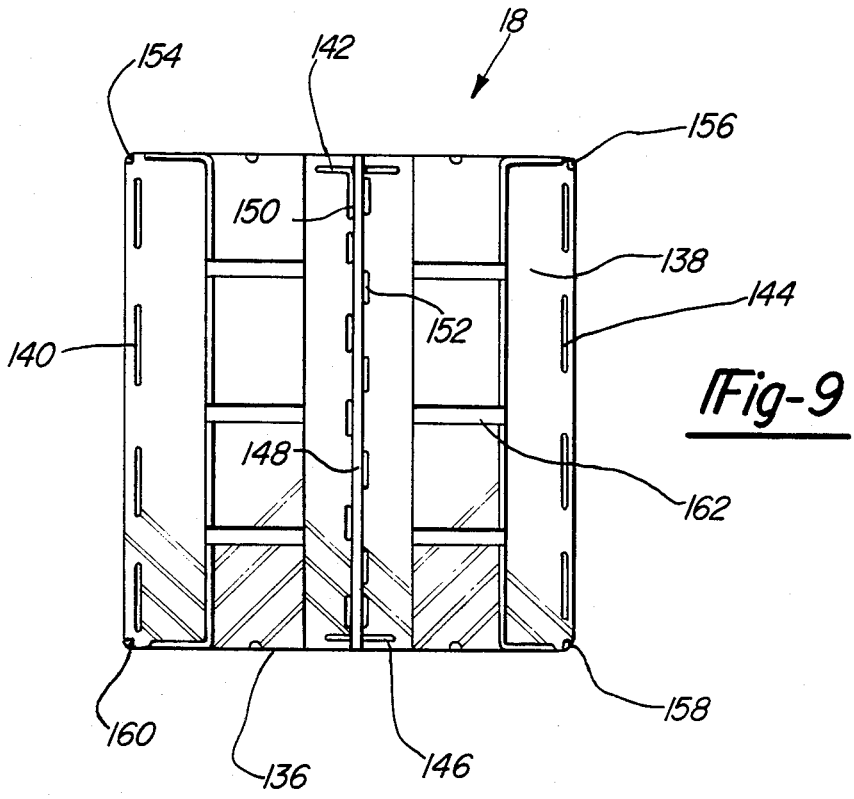
FIG. 9 is a plan view of the underside of the container lid.

Referring now to FIGS. 7 and 8, it will be noted that the sidewall structure 14 comprises four vertical wall members 90, 92, 94, 96. Hinge means 98, 100, 102, 104 connect the four wall members together along vertical edges thereof to form a generally box-like structure when erected as shown in FIG. 7. The hinge means are fabricated of a flexible plastic material having a web 106 extending between adjacent cup-shaped elements 108, 110 which are secured to the edges of the wall members as by adhesion. When the sidewall structure 14 is erected as shown in FIG. 7, space exists between elements 108, 110. As previously mentioned, the lower corners are received on projections 76, 78, 80, 82. The lower edges of the wall members 90, 92, 94, 96 are received in the spaces between the pallet lug structure and pallet sidewall means as aforesaid as may be noted in FIGS. 1 and 2.

Each of two oppositely disposed wall members 90, 94 of the sidewall structure 14 comprise a pair of panels 112, 114 and 116, 118 of substantially equal size. The hinge means 98, 100, 102, 104 connect one vertical edge of each panel to a vertical edge of the adjacent sidewall member 92, 96 to result in the aforesaid connection. Additional hinge means 120, 122 of the type previously described connect the remaining adjacent vertical edge of each pair of adjacent panels 112, 114 and 116, 118 together. A vertical channel 124, 126 is defined by the hinge means 120, 122 and adjacent edges of each pair of adjacent panels 112, 114 and 116, 118. Each of the vertical channels 124, 126 is in alignment with the channel structure defined by the ribs 72, 74 on the upper surface of the pallet bottom wall 20 when the sidewall structure 14 is mounted in the pallet 12.

As shown in FIGS. 7 and 8, the sidewall structure 14 is capable of being collapsed from the erected condition shown in FIG. 7 to the folded conditions shown in FIG. 8 to assume a relatively flat storage condition in which the panels 112, 114 and 116, 118 are folded between the adjacent wall members 92, 96. As previously mentioned, the sidewall structures 14 are commercially available items and do not per se form a part of the present invention.

The divider 16 comprises a wall member which is preferably fabricated of the same sheet material as the wall members of the sidewall structure 14. The divider is used in an erected container to extend between the wall members 90, 94. This provides structural integrity for the container. The divider 16 has vertical edge portions which are received in the vertical channels 124, 126. The vertical edge portions have a pair of spaced apart projections 128, 130 which are inserted into the structure of the divider and held in place as by adhesion. The projections 128, 130 are elongated and extend outwardly from the upper portion of the divider. The projections terminate intermediate the upper and lower edges of the divider. As will be noted, the upper corners, 132, 134 of the divider are angled to conform to the outward flare of the sidewall means 136 of the lid 18. However, such angling is not entirely necessary and may be dispensed with.

The lower edge portion of the divider 16 is received in the channel structure of the bottom wall 20, defined by the ribs 72, 74 with the lower corner portions of the divider being received between the pairs of spaced apart projections 76, 78 and 80, 82 as previously described.

The lid 18 is generally rectangular and has a top wall 138 with an upper face and a lower face. The sidewall means 136 extends around the periphery of the top wall 138 on the lower face thereof. Lug structure is provided on the lower face of the top wall 138 extending around the inner periphery of the lid sidewall means 136. The lug structure comprises a plurality of spaced-apart lug elements 140, 142, 144, 146 provided along each edge portion of the sidewall means 136. The lug structure is spaced from the sidewall means 136 to form, with the lid sidewall means 136, a support structure received on the upper edges of the sidewall structure 14 as will be noted in FIG. 2.

Channel structure is provided on the lower surface of the top wall extending between the sidewall structure vertical channels 124, 126 when the container is erected. The channel structure comprises a channel 148 formed integrally with the top wall 138. Spaced-apart projections 150, 152 are also provided on the lower surface of the top wall 138 on each side of the channel 148 to provide additional channel structure.

A projection 154, 156, 158, 160 is provided on the lower face of the top wall 138 in each corner thereof and is received in the upper corner edges of the sidewall structure 14 in a manner similar to that described for the pallet. Depressions 162 are provided in the top wall 138 to receive straps for the purpose previously mentioned. The lid 18 is also generally ribbed for reinforcing as previously described in connection with the pallet 12.

Figure 6:
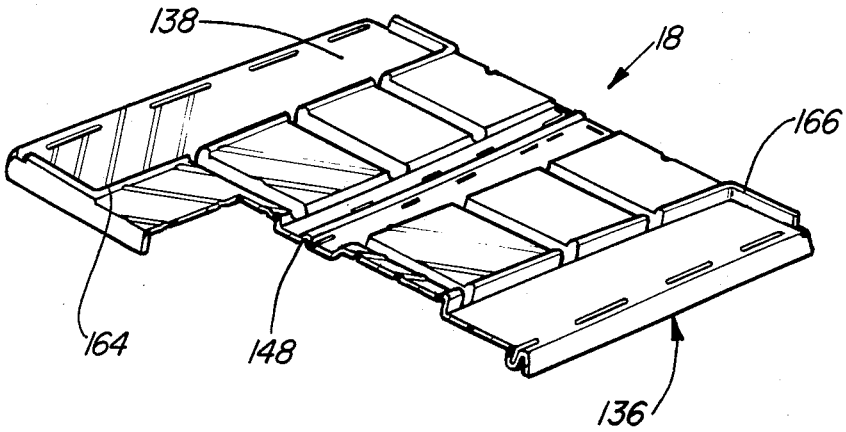
FIG. 6 is a view in perspective of the container lid with portions broken away for the purpose of clarity.
Figure 10:
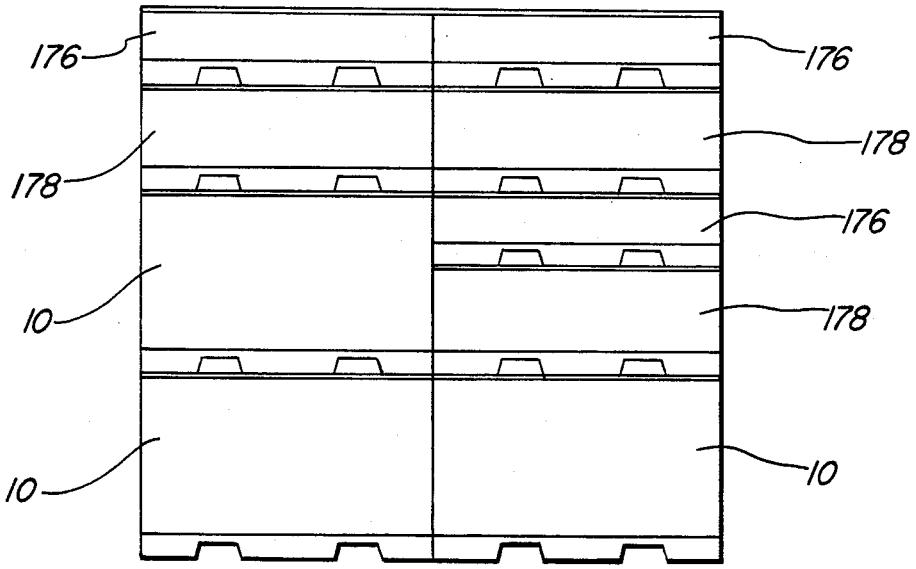
FIG. 10 is a view illustrating one stacking configuration for erected containers.

As will be noted in FIGS. 5 and 6, the lower face of the pallet bottom wall 20 and lid top wall 138 each have an irregular surface configuration. The top wall is further provided With a pair of U-shaped ribbed structure 164, 166 on the upper face thereof adjacent opposed edges thereof. The irregularaties of the two surfaces mate when one container is stacked upon another as illustrated in FIG. 10 to thereby block the two surfaces against sliding with respect to each other.

Figure 3:
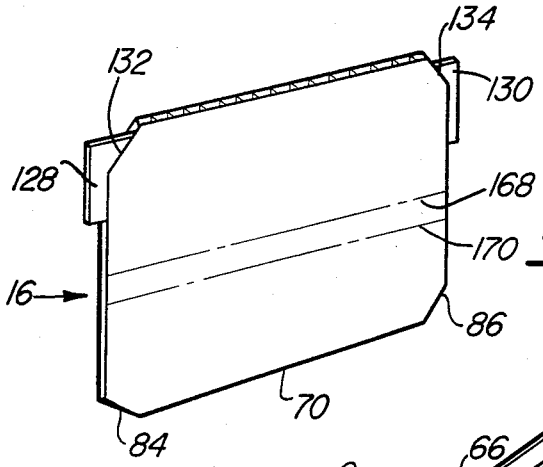
FIG. 3 is a view in perspective of the container divider.

As illustrated by the lines 168, 170 on the divider 16 as shown in FIG. 3, and lines 172, 174 shown on the sidewall structure 14 in FIG. 7, the sidewall structure 14 and divider 16 are provided in three sizes comprising small, medium and large. Each set of differently sized sidewall structures 14 and dividers 16 form containers 176, 178, 10 (FIG. 10) which are, respectively, small, medium and large as shown in FIG. 10. The sidewall structures 14 and dividers 16 are sized so that the height of a small container 176 plus a medium 178 is substantially equal to the height of a large container 180. This results in the erected containers being stackable in uniform fashion in a storage area particularly with reference to a cargo trailer. Representative height dimensions of the sidewall structures and dividers may, for example, be a small sidewall structure of 9.7 inches, a medium sidewall structure of 12.7 inches and a large sidewall structure of 25.6 inches. A small divider may be twelve inches, a medium divider fifteen inches, and a large divider twenty-eight inches in height.

The pallets 12 and lids 18 are preferably fabricated of a tough plastic material and have relatively thin walled members.

Figure 11:
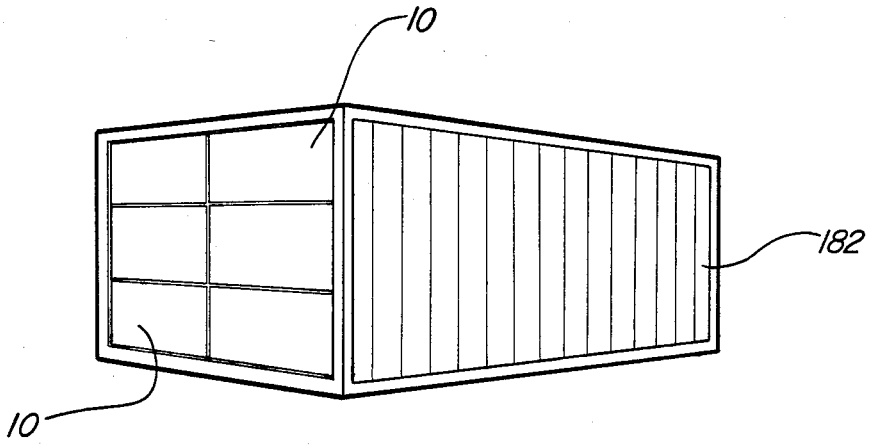
FIG. 11 is a view in perspective of a cargo trailer loaded with erected containers.
Figure 12:
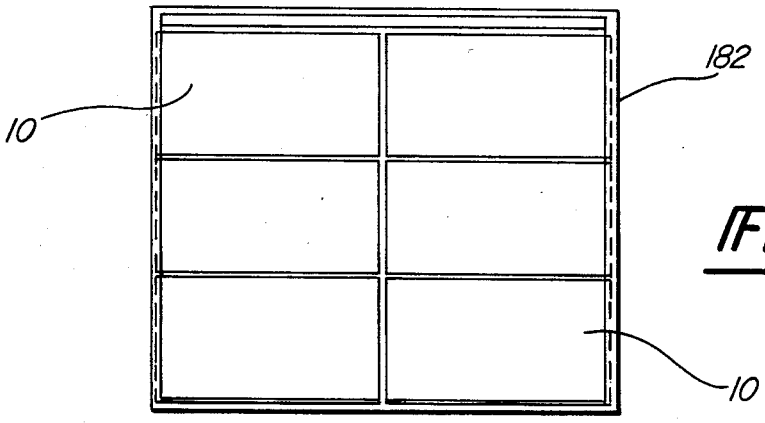
FIG. 12 is an end elevational view of the loaded cargo trailer of FIG. 11.
Figure 13:
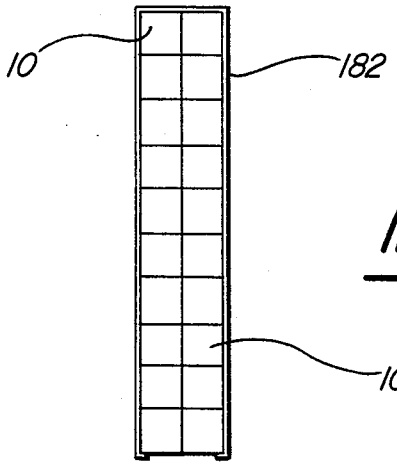
FIG. 13 is a top plan view of the loaded cargo trailer of FIG. 11 with the top removed for the purpose of clarity.

As will be noted in FIGS. 11, 12 and 13, erected containers are adapted to be mounted three high in two side-by-side stacks in a cargo trailer 182. The containers are adapted to be loaded longitudinally in a cargo trailer in units of ten stacks as shown in FIG. 13. This maximizes the cubic stowage thereby reducing transportation costs.

I claim:

1. A container construction comprising a pallet, a sidewall structure, a divider and a lid, the pallet being generally rectangular and including a bottom wall having an upper face and a lower face, sidewall means extending around the periphery of the bottom wall on the upper face thereof, the bottom wall having a pair of substantially parallel spaced apart hollow open-ended raised portions on the upper face extending between two opposed edges of the bottom wall defining a pair of channels to receive the skids of a fork lift truck, lug structure on the upper face of the bottom wall extending around the inner periphery of the pallet sidewall means and spaced therefrom to form, with the pallet sidewall means, a support structure receiving the lower edges of the sidewall structure, channel structure on the upper surface of the bottom wall extending between and substantially parallel to the hollow raised portions for receiving the lower edge of the divider, the sidewall structure comprising four vertical wall members, first hinge means connecting the four wall members together along vertical edges thereof to form a generally rectangular boxlike structure with the lower edges thereof being received in the space between the lug structure and pallet sidewall means as aforesaid, each of two oppositely disposed wall members of the sidewall structure comprising a pair of panels of substantially equal size, the first hinge means connecting one vertical edge of each panel to a vertical edge of an adjacent sidewall member to result in the aforesaid connection, second hinge means connecting the remaining adjacent vertical edges of each pair of adjacent panels together, a vertical channel defined by the second hinge means and adjacent edges of each pair of adjacent panels, each of said vertical channels being in alignment with the channel structure on the upper surface of the pallet bottom wall, the divider comprising a wall member extending between the side wall members which comprise a pair of panels and having vertical edge portions received in said vertical channels and a lower edge portion received in the channel structure on the upper surface of the pallet bottom wall with lower corner portions of the divider being received between said pairs of spaced apart projections, the lid being generally rectangular and having a top wall with an upper face and a lower face, sidewall means extending around the periphery of the top wall on the lower face thereof, lug structure on the lower face of the top wall extending around the inner periphery of the lid sidewall means and spaced therefrom to form, with the lid sidewall means, a support structure received on the upper edges of the sidewall structure, channel structure on the lower surface of the top wall extending between the vertical channels defined by the second hinge means and panels, the divider having an upper edge portion received in the channel structure on the lower surface of the top wall.

2. A container as defined in claim 1, further characterized in that the lug structure on the upper face of the bottom wall comprises a plurality of spaced-apart lug elements, a shelf structure extending from each lug element to the pallet side wall means for support of the lower edges of the sidewall structure, the shelf structure being spaced from the bottom wall and in horizontal alignment with the raised portions.

3. A container as defined in claim 2, further characterized in the provision of a plurality of shelf structures on the pallet side wall means, each shelf structure being positioned between a pair of lug elements and in alignment with the shelf structures of the lug elements for support of the lower edges of the sidewall structure.

4. A container construction as defined in claim 1, further characterized in that the lug structure on the lower face of the top wall comprises a plurality of spaced-apart lug elements.

5. A container as defined in claim 1, further characterized in that the channel structure on the upper surface of the bottom wall comprises a pair of elongated, generally parallel spaced-apart rib elements.

6. A container construction as defined in claim 5, further characterized in that said rib elements terminate short of the pallet sidewall means.

7. A container construction as defined in claim 5, further characterized in the provision of a pair of spaced apart projections on the pallet sidewall means at each end of the channel structure on the upper surface of the bottom wall with the spaces therebetween being in alignment with said channel structure and receiving corner portions of the lower edge of the divider.

8. A container as defined in claim 1, further characterized in that each vertical edge portion of the divider has an elongated projection extending outwardly from the upper portion thereof, said projections terminating intermediate the upper and lower edges of the divider.

9. A container as defined in claim 1, further characterized in that the channel structure on the lower surface of the top wall comprises a channel formed integrally with the top wall.

10. A container as defined in claim 9, further characterized in the provision of spaced-apart projections provided on the lower surface of the top wall adjacent each side of the channel to provide additional channel structure.

11. A container as defined in claim 1, further characterized in that the lower face of the pallet bottom wall and the upper face of the lid top wall each have an irregular surface configuration, the irregularities of the two surfaces mating when one container is stacked upon another to thereby block the two surfaces against sliding with respect to each other.

12. A container construction as defined in claim 1, further characterized in that the sidewall structures and dividers are provided in three sizes comprising small, medium and large, each set of differently sized sidewall structures and dividers forming containers which are, respectively, small, medium and large, the sidewall structures and dividers being sized so that the height of a small plus medium container is substantially equal to the height of a large container.

13. A container construction comprising a pallet, a sidewall structure, a divider and a lid, the pallet being generally rectangular and including a bottom wall having an upper face and a lower face, sidewall means extending around the periphery of the bottom wall on the upper face thereof, the bottom wall having a pair of substantially parallel spaced apart hollow open-ended raised portions on the upper face extending between two opposed edges of the bottom wall defining a pair of channels to receive the skids of a fork lift truck, lug structure on the upper face of the bottom wall extending around the inner periphery of the pallet sidewall means and spaced therefrom to form, with the pallet sidewall means, a support structure receiving the lower edges of the sidewall structure, a shelf structure extending from the lug structure to the pallet sidewall means for support of the lower edges of the sidewall structure, the shelf structure being spaced from the bottom wall and in horizontal alignment with the raised portions, channel structure on the upper surface of the bottom wall extending between and substantially parallel to the hollow raised portions for receiving the lower edge of the divider, a pair of spaced apart projections on the pallet sidewall means at each end of the channel structure on the upper surface of the bottom wall with the spaces therebetween being in alignment with said channel structure and receiving corner portions of the lower edge of the divider, the sidewall structure comprising four vertical wall members, first hinge means connecting the four wall members together along vertical edges thereof to form a generally rectangular box-like structure with the lower edges thereof being received in the space between the lug structure and pallet wall means as aforesaid, each of two oppositely disposed wall members of the sidewall structure comprising a pair of panels of substantially equal size, the first hinge means connecting one vertical edge of said panels to a vertical edge of an adjacent sidewall member to result in the aforesaid connection, second hinge means connecting the remaining adjacent vertical edges of each pair of adjacent panels together, a vertical channel defined by the second hinge means and adjacent edges of each pair of adjacent panels, each of said vertical channels being in alignment with the channel structure on the upper surface of the pallet bottom wall, the divider comprising a wall member extending between the sidewall members which comprise a pair of panels and having vertical edge portions received in said vertical channels and a lower edge portion received in the channel structure on the upper surface of the pallet bottom wall with lower corner portions of the divider being received between said pairs of spaced apart projections, said vertical edge portions of the divider each having an elongated projection extending outwardly from the upper portion thereof, said projections terminating intermediate the upper and lower edges of the divider, the lid being generally rectangular and having a top wall with an upper face and a lower face, sidewall means extending around the periphery of the top wall on the lower face thereof, lug structure on the lower face of the top wall extending around the inner periphery of the lid sidewall means and spaced therefrom to form, with the lid sidewall means, a support structure received on the upper edges of the sidewall structure, channel structure on the lower surface of the top wall extending between the vertical channels defined by the second hinge means and panels, the divider having an upper edge portion received in the channel structure on the lower surface of the top wall, the lower face of the pallet bottom wall and the upper face of the lid top wall each having an irregular surface configuration, the irregularities of the two surfaces mating when one container is stacked upon another to thereby block the two surfaces against sliding with respect to each other.

* * * * *